United States Patent [19]

Bouffard

[11] 4,381,249

[45] Apr. 26, 1983

[54] RUST REMOVING AND METAL SURFACE PROTECTING COMPOSITION

[76] Inventor: Joseph O. Bouffard, 77, rue Hēbert, Granby, Quēbec, Canada, J2G 7V7

[21] Appl. No.: 38,825

[22] Filed: May 14, 1979

[51] Int. Cl.[3] ..... C11D 1/44; C23F 9/02; C23G 1/06; C23G 1/08

[52] U.S. Cl. ..... 252/136; 148/6.17; 252/147; 252/149; 252/391; 252/526; 252/529

[58] Field of Search ..... 252/149, 148, 391, 82, 252/87, 526, 529, 136; 148/6.17

[56] References Cited

U.S. PATENT DOCUMENTS

| | | | |
|---|---|---|---|
| 3,047,510 | 7/1962 | Cizek | 252/136 |
| 3,188,292 | 6/1965 | Pirotte | 252/149 |
| 3,277,011 | 10/1966 | Chadwick | 252/149 |
| 3,325,415 | 6/1967 | Kenney | 252/144 |
| 3,578,607 | 5/1971 | Riggs | 252/389 |

FOREIGN PATENT DOCUMENTS

| | | | |
|---|---|---|---|
| 1031675 | 5/1978 | Canada | 148/6.17 |

*Primary Examiner*—Dennis L. Albrecht
*Attorney, Agent, or Firm*—Schwartz, Jeffery, Schwaab, Mack, Blumenthal & Koch

[57] ABSTRACT

A rust removing and metal surface protecting composition, which comprises about 99.5% by weight of phosphoric acid at 85% concentration, from 0.11 to 0.14% by weight of 1,3-dibutyl thiourea, from 0.09 to 0.11% by weight of 1,3-diethyl thiourea, about 0.025% by weight of a non-ionic surface active agent, from 0.10 to 0.20% by weight of an organic solvent, and from 0.08 to 0.18% by weight of an amine selected from the group consisting of polyoxyethylene fatty alkyl amines containing 2 to 15 moles of ethylene oxide, the fatty alkyl group of which being derived from fatty acids having 12 to 18 carbon atoms. The composition is effective in removing rust on metal surfaces and protecting the metal against corrosion with a hard, crystalline phosphate coating. It can be easily applied by dipping, spraying or brushing.

9 Claims, No Drawings

RUST REMOVING AND METAL SURFACE PROTECTING COMPOSITION

This invention is directed towards improvements in rust removers. More particularly, the invention is concerned with a liquid composition which can be easily applied by dipping, spraying or brushing and is effective in removing rust on metal surfaces and protecting the metal against corrosion with a hard, crystalline phosphate film.

Steel commonly rusts by an electrochemical process called oxygen absorption. All that is required is an electrolyte, which simply may be moisture in the air, and oxygen. Rusting frequently begins at a scratch or nick in a protective coating, which exposes bare steel to the electrolyte. Iron readily gives up electrons to the crystalline metal and frees itself to the electrolyte. These electrons migrate throughout the base metal seeking a location for a cathodic reaction for equilibrium. At one or more points, the electrons eventually find their way back to the electrolyte; in some cases, however, the electrons migrate directly through solid layers of coatings as a result of an electrical "potential" difference between two or more surfaces. At this point, electrons combine with the water and oxygen to form hydroxyl ions which unite with the ferrous ions in the electrolyte and, through a series of chemical reactions, rust is formed. Once established, these reactions are self-generating.

Known rust-removers generally containing a strong mineral acid attack the metal as well as the rust, so that careful surveyance must be made and the acid removed by washing as soon as the rust has disappeared. Moreover, these do not leave a rust-preventive coating and it is thus necessary to protect the bare and cleaned metal against corrosion by applying a resinous or silicone protective coating. But openings in the coating, whether caused by physical damage or incomplete application, become instantaneous sites for anodic or cathodic reactions that cause rust. In some cases, conditions may be so severe that anodic and cathodic reactions may take place through the protective coating. This happens in extremely harsh environments where the electrolyte is strong enough to encourage ions to migrate through the coating. Design and internal metallurgical variations also encourage rusting by creating strong electrical fields within the metal.

It is therefore an object of the present invention to provide a composition which does not attack the metal itself and yet efficiently removes rust and further leaves at the same time a protective coating which strongly adheres to the metal surface, acts as a barrier to air and water, and even resists migration of ions and electrons from the metal to the surface.

In accordance with the invention, there is thus provided a rust removing and metal surface protecting composition, which comprises about 99.5% by weight of phosphoric acid at 85% concentration, from 0.11 to 0.14% by weight of 1,3-dibutyl thiourea, from 0.09 to 0.11% by weight of 1,3-diethyl thiourea, about 0.25% by weight of a non-ionic surface active agent, from 0.10 to 0.20% by weight of an organic solvent, and from 0.08 to 0.18% by weight of an amine selected from the group consisting of polyoxyethylene fatty alkyl amines containing 2 to 15 moles of ethylene oxide, the fatty alkyl group of which being derived from fatty acids containing 12 to 18 carbon atoms.

Applicant has found quite unexpectedly that the above amines chemically combine with the phosphoric acid to provide an electrically neutral phosphate layer that insulates electrical fields within the metal from the surface, thereby inhibiting electrochemical rusting reactions. Not only does this layer insulate the metal from the atmosphere, but its rough crystalline surface provides "teeth" that help a layer of paint cling to the surface.

The composition of the invention is obtained by first mixing the thioureas together and applying heat to cause melting of both compounds. The surface active agent which is non-ionic and should be 100% active is then added to the melt. Any surfactant conventionally employed in the formulation of rust-removers can be utilized; however, use is preferably made of nonylphenoxypolyoxyethylenethanol containing 10–11 moles of ethylene oxide which is sold under the trademark IGEPAL CO-710. An organic solvent is generally added to assist in dissolving the substances such to form a solution; a lower aliphatic alcohol, such as isopropyl alcohol, can be utilized to this end. The amine is finally added and the resulting mixture is stirred in commercial grade phosphoric acid having a concentration of 85%.

The amine employed is a tertiary amine having one fatty alkyl group derived from fatty acids containing 12 to 18 carbon atoms, such as coco fatty acid, oleic acid, soya fatty acid, tallow fatty acid and stearic acid, and two polyoxyethylene groups attached to the nitrogen, and is selected among those containing 2 to 15 moles of ethylene oxide. Preferred amines are polyoxyethylene oleylamines containing 2, 5 and 15 moles of ethylene oxide which are commercially available under the trademarks ETHOMEEN 0/12, 0/15 and 0/25, respectively. Very good results, however, are obtained with ETHOMEEN 0/15, that is, polyoxyethylene oleylamine. In fact, this substance has been found to provide a hard weather-resistant coating, the adhesiveness of which has been determined to be as high as 14 times that of paint.

In use, the composition of the invention must be suitably diluted with water according to the desired needs. Dilution to a concentration ranging between 30 to 50% by volume gives satisfactory results. A composition in a concentration of 45% by volume is suitable for most applications. It is important to add the water to the composition, for the reverse procedure will not result in a homogenized final product. When properly mixed, the final product is a substantially colorless liquid having a viscosity as low as ten times that of water at a same temperature, so that it is extremely penetrating and will succeed in removing rust in areas where conventional rust-removers have failed. It has a very low evaporating rate at room temperature, is safe to handle and is practically odorless. It also has a long shelf time.

The product can be easily applied by dipping, spraying or brushing. Oils and greases must be removed prior to the application. If it is applied by dipping the metal into a bath containing the product, the time of submergence varies in accordance with the temperature of the bath; an increase in temperature decreases the time required for complete cleaning. Thus, the time of submergence is about two hours at 60° F., one hour at 80° F., thirty minutes at 100° F., fifteen minutes at 120° F., eight minutes at 140° F., four minutes at 160° F. and two minutes at 180° F. Above 180° F., the period of time necessary to remove the rust virtually remains the same.

Preferred embodiments of the invention will now be illustrated with reference to the following non limiting examples.

EXAMPLE 1

A rust removing and metal surface protecting composition was prepared from the following compounds:

| | Concentration by weight |
|---|---|
| Phosphoric acid (85% concentration) | 99.500% |
| 1,3-dibutyl thiourea | 0.110% |
| 1,3-diethyl thiourea | 0.090% |
| non-ionic surface active agent | 0.025% |
| organic solvent | 0.195% |
| ETHOMEEN 0/12 | 0.080% |

The composition was diluted with water to a concentration of about 35% by volume. The product was then heated to about 180° F., and a piece of rusted steel immersed into the liquid. The reaction was spontaneous and, within a few minutes, all the rust had disappeared. The piece was removed and left out to dry; it presented a rough, crystalline phosphate coating. In order to increase the thickness of the protective film, the piece was immersed a second time for two minutes. The second application could also have been made with a fine spray of the product by utilizing a suitable sprayer. It is noteworthy to mention in this connection that, once the layer of oxide scale has been removed, the acid did not attack the exposed metal owing to the presence of the dibutyl thiourea which is known for its inhibiting power; however, it has been found that 1,3-diethyl thiourea synergistically acts with the latter to inhibit the attack of the acid on the metal.

Tests performed on the treated piece have indicated that the rust-preventive coating could withstand most severe atmospheric conditions and that the piece would not rust for at least ten years.

EXAMPLE 2

The following composition was prepared:

| | Concentration by weight |
|---|---|
| phosphoric acid (85% concentration) | 99.500% |
| 1,3-dibutyl thiourea | 0.110% |
| 1,3-diethyl thiourea | 0.090% |
| IGEPAL CO-710 | 0.025% |
| isopropyl alcohol | 0.100% |
| ETHOMEEN 0/12 | 0.175% |

The composition was diluted with water to a concentration of about 40% by volume. When applied to a metal surface, not only did the product remove the rust and thoroughly clean the surface, it also left a long-lasting protective coating. Painting can follow immediately upon drying of the surface.

EXAMPLE 3

The following composition was prepared:

| | Concentration by weight |
|---|---|
| phosphoric acid (85% concentration) | 99.500% |
| 1,3-dibutyl thiourea | 0.125% |
| 1,3-diethyl thiourea | 0.100% |

-continued

| | Concentration by weight |
|---|---|
| IGEPAL CO-710 | 0.025% |
| isopropyl alcohol | 0.100% |
| ETHOMEEN 0/15 | 0.150% |

The composition was diluted with water to a concentration of about 45% by volume. The characteristics of the rust-preventive coating obtained with this product were found to be superior to those obtained with the compositions of Examples 1 and 2. The coating presented an increased hardness and it was determined that it could last up to 20 years.

EXAMPLE 4

The following composition was prepared:

| | Concentration by weight |
|---|---|
| phosphoric acid (85% concentration) | 99.500% |
| 1,3-dibutyl thiourea | 0.140% |
| 1,3-diethyl thiourea | 0.110% |
| IGEPAL CO-730 (a nonylphenoxypolyoxyethylenethanol containing 15 moles of ethylene oxide) | 0.025% |
| isopropyl alcohol | 0.125% |
| ETHOMEEN 0/25 | 0.100% |

The composition was diluted with water to a concentration of about 50% by volume. The product was tested and substantially the same results were found as for the composition of Example 2.

EXAMPLE 5

The following composition was prepared:

| | Concentration by weight |
|---|---|
| phosphoric acid (85% concentration) | 99.500% |
| 1,3-dibutyl thiourea | 0.125% |
| 1,3-diethyl thiourea | 0.100% |
| IGEPAL CO-710 | 0.025% |
| isopropyl alcohol | 0.150% |
| ETHOMEEN 0/15 | 0.100% |

The composition was diluted with water to a concentration of about 45% by volume. Various tests carried out with this composition gave substantially the same results as in Example 3.

The embodiments of the invention in which an exclusive property or privilege is claimed are defined as follows:

1. A rust removing and metal surface protecting composition, which consists essentially of about 99.5% by weight of phosphoric acid at 85% concentration, from 0.11 to 0.14% by weight of 1,3-dibutyl thiourea, from 0.09 to 0.11% by weight of 1,3-diethyl thiourea, about 0.025% by weight of a non-ionic surface active agent, from 0.10 to 0.20% by weight of a lower monohydric alcohol, and from 0.08 to 0.18% by weight of an amine selected from the group consisting of polyoxyethylene fatty alkyl amines containing 2 to 15 moles of ethylene oxide, the fatty alkyl group of which being derived from fatty acids containing 12 to 18 carbon atoms.

2. A composition as claimed in claim 1, wherein the surface active agent is a nonylphenoxypolyoxyethylenethanol containing 10–11 moles of ethylene oxide.

3. A composition as claimed in claim 1, wherein the alcohol is isopropyl alcohol.

4. A composition as claimed in claim 1, wherein the amine is a polyoxyethylene oleylamine containing 5 moles of ethylene oxide.

5. A composition as claimed in claim 1 or 4, wherein the amine is present in an amount of 0.15% by weight.

6. A composition as claimed in claim 1, which contains about 99.5% by weight of phosphoric acid at 85% concentration, about 0.125% by weight of 1,3-dibutyl thiourea, about 0.100% by weight of 1,3-diethyl thiourea, about 0.025% by weight of a non-ionic surface active agent, about 0.10% by weight of isopropyl alcohol and about 0.15% by weight of a polyoxyethylene oleylamine containing 5 moles of ethylene oxide.

7. A composition as claimed in claim 6, wherein the surface active agent is a nonylphenoxypolyoxyethylenethanol containing 10–11 moles of ethylene oxide.

8. A composition as claimed in claims 1, 6 or 7, diluted with water to a concentration ranging between 30 and 50% by volume.

9. A composition as claimed in claims 1, 6 or 7, diluted with water to a concentration of about 45% by volume.

* * * * *